United States Patent [19]

Bäbler et al.

[11] Patent Number: 5,075,195

[45] Date of Patent: Dec. 24, 1991

[54] LASER MARKING OF PLASTICS OBJECTS OF ANY DESIRED SHAPE WITH SPECIAL EFFECTS

[75] Inventors: Fridolin Bäbler, Hockessin, Del.; Manfred Hofmann, Marly, Switzerland

[73] Assignee: Ciba-Geigy Corporation, Ardsley, N.Y.

[21] Appl. No.: 565,768

[22] Filed: Aug. 10, 1990

[30] Foreign Application Priority Data

Aug. 18, 1989 [CH] Switzerland ..... 3011/89

[51] Int. Cl.[5] ..... G03C 8/00

[52] U.S. Cl. ..... 430/200; 264/22; 346/76 L; 430/945

[58] Field of Search ..... 264/22; 346/76 L; 430/200, 945

[56] References Cited

U.S. PATENT DOCUMENTS 4,307,047 12/1981 Edinger et al. .
4,391,764 7/1983 Edinger et al. .
4,401,992 8/1983 Vorst et al. .
4,654,290 3/1987 Spanjer ..... 264/22
4,769,310 9/1988 Gugger et al. ..... 430/945
4,861,620 8/1989 Azuma et al. ..... 430/945
4,947,750 8/1990 Lewis et al. ..... 101/459

FOREIGN PATENT DOCUMENTS 58-210937 12/1983 Japan .
60-155493 8/1985 Japan .

*Primary Examiner*—David A. Simmons
*Assistant Examiner*—Merrick Dixon
*Attorney, Agent, or Firm*—Luther A. R. Hall

[57] ABSTRACT

A method of laser marking plastics objects of any desired shape, wherein the object to be marked contains a radiation-sensitive additive which effects a change in the light reflectance and is subjected to a laser with pulsed light such that the laser beam is deflected through a mask or directed over the surface of the object to be marked, in conformity with the shape of the marking which is to be applied so as to form a visual effect marking at the areas of impact on said object without the surface of said object suffering damage which is visible to the eye. The method includes using molybdenum disulfide as additive and choosing the laser parameters of wavelength, pulse content and pulse duration such that an effect marking is produced whose contrast undergoes visual change depending on the angle of light and observation.

12 Claims, No Drawings

LASER MARKING OF PLASTICS OBJECTS OF ANY DESIRED SHAPE WITH SPECIAL EFFECTS

The present invention relates to a process for laser marking plastics objects of any desired shape with special effects, and to the material so marked.

It is known to mark plastics objects by irradiation with a laser beam to produce contrast marks at the areas of impact on the plastics object. To this end, the material to be marked is often mixed with a laser-sensitive additive which undergoes a change in colour, loses colour, decomposes, or effects a change in colour as a result of absorption of the laser energy, so that a contrast marking is produced at the areas of impact on the surface of the material to be marked (q.v. European patent applications 0 036 680 and 0 190 997, as well as U.S. Pat. No. 4,307,047).

To produce colour contrast markings it has been proposed to use, for example, a mixture of different dyes as additive, only one component of which mixture undergoes a change in colour, or loses colour, to produce a colour contrast at the areas of impact on the surface of the object to be marked (q.v. JP Kokai Sho 58-210 937 or 60-155 493).

The use of carbon black and graphite has also been proposed for laser marking plastics materials. According to the teaching of U.S. Pat. No. 4,391,764, carbon black or graphite is mixed with the plastics material in such a concentration that absorption of energy radiation brings about a localised decomposition (a melt/gasification effect) in the material, and thus normally produces a black-white contrast marking.

The above described processes and compositions, however, do not meet all the current requirements of practice. Often the surface of the marked material is severely damaged at the areas of impact, resulting in unwanted grooves, indentations or scratches and, in addition, in marks of insufficient general properties such as insufficient abrasion- and scratch-proof resistance, poor resistance to chemicals and soiling, as well as edge zones of poor definition. Moreover, these processes produce marks which are visually almost identical when viewed from every angle of observation.

A laser marking process has now been found for producing effect marks which, depending on the angle of light and observation appear clearly visible or completely invisible, and furthermore have excellent general properties such as abrasion- and scratch-resistance, as well as good resistance to chemicals, light and atmospheric influences. In addition, the novel process permits a so-called subcutaneous marking of the material without the surface of the object suffering damage which is visible to the eye.

Accordingly, the present invention relates to a process for laser marking plastics objects of any desired shape, wherein the object to be marked contains a radiation-sensitive additive which effects a change in the light reflectance and is subjected to a laser with pulsed light, such that the laser beam is deflected through a mask or directed over the surface of the object to be marked, in conformity with the shape of the marking which is to be applied so as to form a visual effect marking at the areas of impact on said object without the surface of said object suffering damage which is visible to the eye, which process comprises using molybdenum disulfide as additive and choosing the laser parameters of wavelength, pulse content and pulse duration such that an effect marking is produced whose contrast undergoes visual change depending on the angle of light and observation.

The effect of the marking produced in the performance of this invention is unique, as the marking is visible from specific angles of exposure and observation but invisible from other angles. Usually the marking is black from greater angles of observation, for example from angles of 60°-90°. From narrower angles of observation, i.e. from lateral observation, the dark marking disappears, in other words no more contrast is detectable. When using thin sheets, for example PVC sheets, the process of the invention makes it possible to produce a marking which has the additional effect of causing the marking to appear dark from the top view, but bright and almost transparent when viewed in perspective.

The plastics material may comprise, for example, modified natural materials, such as cellulose derivatives, for example cellulose esters or cellulose ethers and, in particular, man-made organic polyplastics, that is to say, plastics which are obtained by polymerisation, polycondensation and polyaddition. The following products may be mentioned in particular as belonging to this class of plastics: polyolefins such as polyethylene, polypropylene, polybutylene or polyisobutylene, polystyrene, polyvinyl chloride, and polyvinylidene chloride, the fluorinated polymers such as polytetrafluoroethylene, and polyvinyl acetals, polyacrylonitrile, polyacrylates, polymethacrylates or polybutadiene, and copolymers thereof, in particular ABS or EVA; polyesters, in particular high molecular esters of aromatic polycarboxylic acids and polyfunctional alcohols, polyamides, polyimides, polycarbonates, polyurethanes, polyethers such as polyphenylene oxide, and also polyacetals; the condensates of formaldehyde and phenols (phenolic plastics), and the condensates of formaldehyde and urea, thiourea and melamine (aminoplasts); the polyadducts and polycondensates of epichlorohydrin and diols or polyphenols known as epoxy resins; and also the unsaturated polyesters used as surface-coating resins, for example maleic resins. It must be emphasised that not only the homogeneous compounds can be used in the practice of this invention, but also mixtures of polyplastics, as well as co-condensates and copolymers, for example those based on butadiene.

Plastics materials in dissolved form as film formers or binders for coating compositions or printing inks are also suitable, for example boiled linseed oil, nitrocellulose, alkyd resins, phenolic resins, melamine resins, acrylic resins and urea/formaldehyde resins, the films obtained from which materials can be marked by the process of the invention.

Plastics materials which are particularly suitable for the process of this invention are polyvinyl chloride, polyvinyl esters such as polyvinyl acetals, and also polyacrylates and polymethacrylates, polyesters, polyamides, polyimides, polycarbonates, polyurethanes, polyethers, preferably polyphenylene oxides, as well as polyacetals, phenolic plastics, aminoplasts, epoxy resins and, most preferably, polyolefins such as polyethylene and polypropylene.

The molybdenum disulfide is suitably molybdenum disulfide in flake or platelet form with a particle diameter size of less than 100 μm, most preferably 0.1 to 25 μm, and a thickness of up to 4 μm.

Starting from commercially available molybdenum disulfide, the molybdenum disulfide used in the practice of this invention is obtained in the preferred state in known manner, for example by grinding in air jet, sand or ball mills. Substantially planar molybdenum disulfide particles in platelet or flake form are obtained, for example by wet grinding coarse crystalline molybdenum disulfide in a grinding apparatus which contains metal, glass or porcelain balls, plastic granules or sand grains as grinding media. The grinding media are set in motion, for example, by rotating the apparatus or by a vibration exciter or stirrer.

The optimum effect markings can be determined by varying the amount of molybdenum disulfide within the range indicated below. For plastics materials in the form of coating compositions or printing inks, it is preferred to use from 1.0 to 15.0% by weight, more particularly from 1.0 to 10% by weight, based on the dry coating or printing ink layer. For mass coloured plastics materials it is preferred to use 0.01 to 5.0% by weight, more particularly from 0.05 to 1% by weight, based on the plastics material.

It is especially preferred to use molybdenum disulfide in flake or platelet form containing 60–95% by weight of particles having a median particle size of 1–12 μm. Conveniently they have a diameter of 0.1–25 μm.

In addition to the molybdenum disulfide it may be convenient to add an additional colourant or mixture of colourants to the plastics object. The colourant or mixture of colourants may, however, only be added in such a concentration that the effect marking produced in the practice of this invention is not impaired or covered. Depending on the plastics material, coating material or printing ink, the concentration is conveniently 0.01 to 0.5% by weight or 0.5 to 5% by weight.

Suitable additional colourants are inorganic or organic pigments as well as polymer-soluble dyes, especially those which absorb in the visible range.

Examples of inorganic pigments are white pigments such as titanium dioxides (anatas, rutile), zinc oxide, antimony oxide, zinc sulfide, lithopones, basic lead carbonate, basic lead sulfate or basic lead silicate, and also coloured pigments such as iron oxides, nickel antimony titanate, chromium antimony titanate, manganese blue, manganese violet, cobalt blue, cobalt chromium blue, cobalt nickel grey or ultramarine blue, Berlin blue, lead chromates, lead sulfochromates, molybdate orange, molybdate red, cadmium sulfides, antimony trisulfide, zirconium silicates such as zirconium vanadium blue and zirconium preseodyme yellow, and also carbon black or graphite in low concentration, and also other effect pigments such as aluminium metal, iron oxide-coated aluminium pigments or mixed phase pigments in platelet form, such as iron oxide in platelet form doped with $Al_2O_3$ and/or $Mn_2O_3$, as well as pearlescent pigments such as basic lead carbonate, bismuth oxychloride, bismuth oxychloride on carrier and, in particular, the titanium dioxide-coated mica pigments, which last mentioned pigments may also contain other coloured metal oxides such as iron oxides, cobalt oxides, manganese oxides or chromium oxides.

Examples of organic pigments are azo, azomethine, methine, anthraquinone, indanthrone, pyranthrone, flavanthrone, benzanthrone, phthalocyanine, perinone, perylene, dioxazine, thioindigo, isoindoline, isoindolinone, quinacridone, pyrrolopyrrole or quinophthalone pigments, and also metal complexes, for example of azo, azomethine or methine dyes or metal salts of azo compounds, as well as organic pigments in platelet form.

Suitable polymer-soluble dyes are, for example, disperse dyes such as those of the anthraquinone series, for example hydroxyanthraquinones, aminoanthraquinones, alkylaminoanthraquinones, cyclohexylaminoanthraquinones, arylaminoanthraquinones, hydroxyaminoanthraquinones or phenylmercaptoanthraquinones, as well as metal complexes of azo dyes, in particular 1:2 chromium or cobalt complexes of monoazo dyes, and fluorescent dyes such as those of the coumarin, naphthalimide, pyrazoline, acridine, xanthene, thioxanthene, oxazine, thiazine or benzthiazole series.

In the practice of this invention, the inorganic or organic pigments or polymer-soluble dyes can be used singly or as mixtures, conveniently with or without pigment additives.

Suitable pigment additives are typically fatty acids of at least 12 carbon atoms, for example stearic acid or behenic acid and the amides, salts or esters thereof such as magnesium stearate, zinc stearate, aluminium stearate or magnesium behenate, and also quaternary ammonium compounds such as tri($C_1$–$C_4$)alkylbenzylammonium salts, waxes such as polyethylene wax, resin acids such as abietic acid, colophonium soap, hydrogenated or dimerised colophonium, $C_{12}$–$C_{18}$-paraffin disulfonic acids or alkylphenols, alcohols such as ®TCD-Alcohol M, or vicinal aliphatic 1,2-diols.

The preparation of the plastics objects is effected by methods which are known per se, for example by incorporating the necessary coloured components (molybdenum disulfide and an optional additional colourant) which may be in the form of a masterbatch, into the substrates using extruders, roll mills, mixing or grinding machines. The resultant material is then brought into the desired final form by methods which are known per se, for example calendering, moulding, extruding, coating, casting or by injection moulding. It is often desirable to incorporate plasticisers into the organic material before-processing in order to produce non-brittle mouldings or to diminish their brittleness. Suitable plasticisers are, for example, esters of phosphoric acid, of phthalic acid or of sebacic acid. The plasticisers may be incorporated before or after working colouring components into the polymers.

Depending on the end use, further modifiers may be added to the organic plastics material, for example fillers such as kaolin, mica, feldspar, wollastonite, aluminium silicate, barium sulfate, calcium sulfate, chalk, calcite and dolomite, as well as light stabilisers, antioxidants, flame retardants, heat stabilisers, glass fibres or processing auxiliaries conventionally employed in the processing of plastics and known to the skilled person.

To prepare the coating compositions and printing inks suitable for use in the practice of this invention, the plastics material, the molybdenum disulfide and an optional additional colourant, together with further auxiliaries of coating compositions and printing inks, are finely dispersed or dissolved in a common organic solvent or mixture of solvents. The procedure may be such that the individual components, or also several components jointly, are dispersed or dissolved and then all the components are combined. The homogenised coating composition or printing ink is then applied to the substrate by a technique which is known per se and baked or dried, and the film so obtained is then marked by the process of the invention.

Energy-rich pulsed laser sources are used for marking the plastics objects suitable for use in the practice of this invention. The procedure comprises applying the radiation energy, in conformity with the shape of the marking which is to be applied, conveniently at a steep angle to the surface of the material to be marked, and focusing said radiation energy such that an effect marking is produced at the areas of impact without the surface of the marked material being perceptibly damaged.

Examples of such energy source are solid state pulsed lasers such as ruby lasers or frequency multiplied Nd:YAG lasers, pulsed lasers with booster such as pulsed dye lasers or Raman shifter, and also continuous wave lasers with pulse modifications (Q-switch, mode locker), for example on the basis of CW Nd:YAG lasers with frequency multiplier, or CW ion lasers (Ar, Kr), as well as pulsed metal vapour lasers, for example copper vapour lasers or gold vapour lasers, or hight capacity pulsed semi-conductor lasers which emit visible light by frequency doupling, and also pulsed gas lasers such as excimer and nitrogen lasers.

Depending on the laser system employed, pulse contents of up to several Joules per $cm^2$, intensities of up to $10^{12}$ W/$cm^2$, pulse durations of from $10^{-15}$ seconds to $10^{-6}$ seconds and frequencies of up to $10^9$ Hz are possible. Pulse contents of micro-Joule to kilo-Joule, intensities of kilowatt/$cm^2$ to 100 megawatt/$cm^2$, pulse durations of microseconds to picoseconds, and frequencies of a few hertz to 50 kilohertz are advantageously used.

Preferred lasers are pulsed or pulse-modified, frequency doubled Nd:YAG lasers or metal vapour lasers such as gold or, in particular, copper vapour lasers, as well as excimer lasers.

The following table lists a number of commercially available lasers which may be suitably used in the practice of this invention.

TABLE

| Type/Representative | Examples of commercially available types | Principal wavelength (subsidiary wavelengths) [nm] |
|---|---|---|
| Solid state pulsed lasers | | |
| .ruby laser | Lasermetrics (938R6R4L-4) | 694 (347) |
| .Nd:YAG laser | Quanta Ray (DCR 2A) | 1064, (532, 355, 266) |
| .Alexandrite laser | Apollo (7562) | 730–780 |
| Pulsed lasers with booster such as | | |
| .Raman shifter | Quanta Ray (RS-1) | UV-IR |
| .dye laser | Lambda Physik FL 2002 | ca. 300–1000 |
| CW laser with pulse modification | | |
| .ND:YAG (Q-Switch, 2ω) | Lasermetrics (9560QTG) | 532 |
| .argon (mode-locked) | Spectra-Physics SP 2030 | 514.5<br>488 |
| pulsed metal vapour laser | | |
| .Cu vapour laser | Plasma-Kinetics 751 | 510, 578 |
| .Au vapour laser | Plasma-Kinetics | 628 |
| .Mn vapour laser<br>.Pb vapour laser | Oxford<br>Laser CU 25 | 534, 1290<br>723 |
| Semi-conductor diode lasers | M/A COM Type LD 65 | ca. 905 (402) |
| Semi-conductor diode lasers Array (frequency doubling) | STANTEL Type LF 100 | ca. 905 (402) |
| Pulsed gas lasers | | |
| Excimer | | |
| .XeCl | Lambda Physik | 308 |
| .XeF as well as | EMG-103 | 351 |
| .$N_2$ | | 337 |

In the practice of this invention, the laser employed will be for example a pulsed, frequency double Nd:YAG laser with a pulse content from 0.05 to 1 Joule/$cm^2$, a maximum capacity of about 4 kilowatts, pulse durations of 6–8 nanoseconds and a frequency of 30 Hz (Quanta Ray DCR-2A, available from Spectra Physics, Mountain View, Calif.).

If a copper vapour laser with focusing optic (Plasma Kinetics 151) is used, exposure will be carried out with a pulse content of, for example, 250 milli-Joules/$cm^2$, a maximum capacity of about 10 kW, a pulse duration of 30 nanoseconds and a frequency of 6 kHz.

Lasers whose parameters can be readily adjusted, for example pulse content and pulse duration, permit the best possible adaptation to the requirements of the materials to be marked.

The best wavelength to be selected for the irradiation is that at which the radiation-sensitive $MoS_2$ and the optional additional colourant absorbs most strongly, and that at which the plastics material to be marked absorbs little.

Preferably laser light with a wavelength in the near UV and/or visible range and/or near IR range is used, but most preferably with a wavelength in the visible range.

The expression "visible range" will be understood as meaning the range from 0.38 μm to 0.78 μm, the expression "near IR range" as meaning the range from 0.78 μm to 2 μm, and the expression "near UV range" as meaning the range from 0.25 μm to 0.38 μm.

Three different methods are normally suitable for laser marking in the practice of this invention: the mask method, the linear marking method and the dot matrix method. In these last two mentioned methods (dynamic focusing), the laser is preferably combined with a laser marking system, so that the plastics material can be marked with any, e.g. computer-programmed, digits, letters and special symbols.

The choice of laser system in respect of capacity and frequency depends basically on the marking method employed. The high capacity and low frequency of e.g. solid state pulsed lasers and excimer lasers are preferred for mask exposure. The average to low capacities and rapid frequencies of pulsed metal vapour lasers or of continuous wave lasers with pulse modifications are preferred for producing markings that require dynamic focusing. Beam deflection can be effected, for example, acousto-optically, holographically, with galvo-mirrors or polygon scanners. Dynamic focusing makes possible an extremely flexible marking, as the marks can be produced electronically.

A very wide range of markings can be produced by the present invention. Examples are: variable text programming of numerical symbols by inputting text via a video display unit, text programs of standard symbols or special symbols such as monograms, also initials and inscriptions, identity cards, logos, or frequently recurring data, continuous piece numbering, input of measurable variables, input of a stored program, linear marking or also graphics and decorations, as well as security documents such as cheques, travellers' cheques, bank notes, lottery tickets, credit cards, identity papers in which computer program data are stored, graphic data or documents which can be read with digitisers or scanners.

It is also possible in the practice of this invention to mark a very wide range of plastics parts or mouldings or sheets as well as paint or printing ink films. Ribbons, plates, tubes and profiles, keys and plastics-coated electronic components or differently coloured parts produced by two-phase injection moulding may be cited by way of example. The markings obtained in this invention are also corrosion-proof, dimensionally stable, free from deformation, fast to light, heat and weathering. They have good edge definition and are easily legible by the naked eye in the range initially described without, for example, having to use IR and UV readers. In addition, there is virtually no impairment of the mechanical and physical properties of the marked material, for example mechanical strength and resistance to chemicals. The impression depth of the marking depends on the marked material and is normally less than 1 mm. Damage to the plastics material is minimal. Hence it is possible to obtain markings that give rise to no perceptible loss of surface gloss and do not adversely affect the strength properties of the workpiece.

In the process of this invention, laser irradiation at the areas of impact on the surface of the material to be marked induces a change in reflectance with a variable contrast. Usually, when viewed from the top, there is a colour change from black to grey and, when viewed in perspective, bright markings are observed. When viewed from a narrow or diminished angle of observation, the markings disappear. In addition, depending on the laser system, it is possible to produce a contrast marking which, when viewed under the microscope, additionally has a clearly perceptible fine structure.

If an additional colourant is used, the effect marking appears, when viewed from the top and in perspective, often in the residual shade of the colourant employed.

In the following Examples parts are by weight, unless otherwise stated.

EXAMPLE 1

A mixture of 10.0 g of a molybdenum(IV) sulfide pigment in platelet form and in which 85% of the particles have a particle size of 6–24 μm with a median value of 9.6 μm (measured in a 715 E 598 granulometer supplied by CILAS, F-91463 Marcoussis/FR), 1.0 g of antioxidant (®IRGANOX 1010, CIBA-GEIGY AG) and 1000 g of polyethylene HD granules (®VESTOLEN A 60-16, HUELS) is mixed for 15 minutes in a glass bottle on a roller gear table. The mixture is then extruded in two passages in a single-screw extruder and the granules so obtained are moulded to sheets on an injection moulding machine (Allround Aarburg 200) at 220° C. These sheets are subsequently compression moulded for 5 minutes at 180° C. The pressed sheets have a homogeneous metallic grey lustre.

The pressed sheets are then marked with a laser beam which is deflected through two orthogonal movable mirrors according to the shape of the marking to be applied (in the present instance the marking "GRETAG"; height and width of the letters 6 mm; type width 0.1 mm). The laser used is a Nd:YAG pulsed laser (®Quanta Ray DCR 2, Spectra Physics) with frequency doubler (harmonic generator) and frequency filter (harmonic separator). The laser is adjusted and attenuated with neutral filters such that the beam focused vertically through a lens (focal length 200 mm) on to the surface of the sheet has a pulse content of 0.2 mJ at a pulse duration of 10 nanoseconds. The deflection mechanism with the orthogonal moveable mirrors is part of a ®GRETAG 6210 laser marking system (GRETAG AG, Switzerland) and is mounted vertically over the specimen sheet. The marking so obtained is dark (black on the green substrate when viewed almost vertically) and is clearly distinguished from the unmarked lustrous metallic-grey article. The marking is clearly perceptible or disappears completely as the incidence of light and angle of observation vary.

EXAMPLES 2–9

The plastics granules are blended with the molybdenum disulfide pigment described in Example 1 in accordance with the list given below and injection moulded to sheets measuring 55×45×1.5. The specimens so obtained are marked with the device employed in Example 1 and in accordance with the particulars described therein, except that two marks in the form of a circular arc (¾ circle) and a rectangle (9×9 mm) are each applied twice in place of the "GRETAG" mark.

The marked sheets are all characterised in that the marks are visible only under specific angles of light and observation and disappear almost completely when light falls at an oblique angle.

One specimen of each of the plastics material listed below was exposed for 500 hours in a Weather-O-Meter. All marks were retained.

| Test methods in ABS, PC, PA, Xenoy, PES, PMMA, HDPE, PP (preparation of specimens) | |
|---|---|
| Test in ABS: | |
| test concentration: | 0.1% of molybdenum disulfide pigment; |
| polymer: | ABS [ ® TERLURAN 877M, BASF, DE]; |
| batch: | 1000 g; |
| blending of polymer + pigment: | 3 l glass bottle 15 min. at 60 rpm, roller gear table; |
| extrusion: | 2x at 190° C.-small extruder type 133, [ex Collin, DE]; |
| granulation: | pelletizer-[ex WILCO AG, CH]; |
| drying: | 90° C. for 4 h-granule blower drier [Turb. Etuve TE 25, ex MAPAG AG, CH]; |
| injection temperature: | 220° C.; injection moulder Allround Aarburg 200 [ex Aarburg, DE]; |
| specimen size: | 55 × 45 mm-1.5 mm thick. |
| Test in PC: | |
| test concentration: | 0.1% of molybdenum disulfide pigment; |
| polymer: | ® MACROLON 2800 [BASF]; |
| blending of polymer + pigment: | 15 min. at 60 rpm.; |
| predrying: | 120° C. for 4 h; |
| extrusion: | 2x at 270° C.; |
| drying: | 120° C. for 4 h; |
| moulding temperature: | 300° C. |
| Test in PA 6: | |
| test concentration: | 0.1% of molybdenum disulfide pigment; |
| polymer: | ® ULTRAMID B3K [BASF]; |
| blending of polymer + pigment: | 15 min. at 60 rpm.; |
| predrying: | 120° C. for 4 h; |
| extrusion: | 2x at 220° C.; |
| drying: | 120° C. for 4 h; |
| moulding temperature: | 240° C. |
| Test in ® Xenoy (polycarbonate/polybutadiene | |

-continued

| Test methods in ABS, PC, PA, Xenoy, PES, PMMA, HDPE, PP (preparation of specimens) | |
|---|---|
| terephthalate mixture) | |
| test concentration: | 0.1% of molybdenum disulfide pigment; |
| polymer: | ® XENOY CL 100, powder quality [General Elecric, NL];; |
| blending of polymer + pigment: | 15 min. at 60 rpm.; |
| extrusion: | 2x at 250° C.; |
| drying: | 120° C. for 4 h; |
| moulding temperature: | 280° C. |
| Test in PES | |
| test concentration: | 0.1% of molybdenum disulfide pigment; |
| polymer: | ® MELINOR B 90 [ICI, GB]; |
| blending of polymer + pigment: | 15 min. at 60 rpm.; |
| predrying: | 90° C. for 4 h; |
| extrusion: | 2x at 270° C.; |
| drying: | 90° C. for 4 h; |
| moulding temperature: | 280° C. |
| Test in PMMA | |
| test concentration: | 0.1% of molybdenum disulfide pigment; |
| polymer: | ® Plexiglas N6 [Röhm GmbH, FRG]; |
| blending of polymer + pigment: | 15 min. at 60 rpm.; |
| predrying: | 90° C. for 8 h; |
| extrusion: | 2x at 220° C.; |
| moulding temperature: | 240° C. |
| Test in HDPE | |
| test concentration: | 0.1% of molybdenum disulfide pigment; |
| polymer: | ® VESTOLEN A 6016 [Huls AG, FRG]; |
| blending of polymer + pigment: | 15 min. at 60 rpm.; |
| predrying: | 120° C. for 4 h; |
| extrusion: | 2x at 200° C.; |
| moulding temperature: | 220° C. |
| Test in PP | |
| test concentration: | 0.1% of molybdenum disulfide pigment; |
| polymer: | ® STAMYLAN P 83 HF 10 [DSM, NL]; |
| blending of polymer + pigment: | 15 min. at 60 rpm.; |
| extrusion: | 2x at 200° C.; |
| moulding temperature: | 240° C. |

EXAMPLE 10

200 mg of a molybdenum(IV) sulfide pigment in platelet form in which 80–90% of the particles have a size of 4–25 μm with a median value of 9.5 μm (measured in a 715 E598 granulometer supplied by CILAS, F-91460 Marcoussis/FR), 7.3 ml of dioctyl phthalate and 13.3 g of stabilised polyvinyl chloride are thoroughly mixed in a glass beaker with a glass rod, and the mixture is then processed to a thin sheet on a roll mill at 160° C. for 5 minutes. The sheet so obtained is marked with a laser beam in accordance with Example 1.

The markings so obtained are dark (black on the grey substrate) when viewed vertically, but appear bright when viewed in perspective with pronounced fine structure.

What is claimed is:

1. A method of laser marking a plastics object with a mark of any desired shape, wherein the object to be marked contains a radiation-sensitive additive which effects a change in light reflectance and wherein the object to be marked is subjected to a laser beam with pulsed light such that the laser beam is deflected through a mask or directed over the surface of the object to be marked in conformity with the shape of the mark which is desired to be applied so as to form a visual effect mark at the areas of impact of laser beam on said object without the surface of the object suffering any damage which is visible to the eye, which method comprises using molybdenum disulfide as the radiation-sensitive additive; and choosing parameters of wavelength, pulse content and pulse duration of the laser beam so as to produce a visible effect mark on said object whose contrast undergoes visual change depending on the angle of light impinging thereon and on the angle with which it is visually observed.

2. A method according to claim 1 which comprises using laser light with a wavelength in the near UV range, visible range or near IR range.

3. A method according to claim 1, which comprises using laser light with a wavelength in the visible range.

4. A method according to claim 1, which comprises using a pulsed or pulse-modified, frequency doubled Nd:YAG laser or a metal vapour laser or an excimer laser.

5. A method according to claim 1, which comprises using pulse energies ranging from 1 mJ to kJ/cm$^2$ and pulse durations of $10^{-6}$ to $10^{-12}$ seconds.

6. A method according to claim 1, which comprises using molybdenum disulfide in flake or platelet form having a particle diameter of less than 100 μm and a thickness of up to 4 μm.

7. A method according to claim 1, wherein the plastics object is formed of material selected from the group consisting of a polyvinyl chloride, polyvinyl ester, polyacrylate and polymethacrylate, condensation polyester, polyamide, polyimide, polycarbonate, polyurethane, polyether, polyacetal, phenoplast, aminoplast, epoxy resin and a polyolefin.

8. A method according to claim 1, wherein the plastics object contains an additional colourant or mixture of colourants.

9. A method according to claim 8, wherein the colourant is an inorganic or organic pigment or a polymer-soluble dye.

10. A plastic object marked by the method as claimed in claim 1.

11. A method according to claim 1 wherein the amount of molybdenum disulfide additive is 0.01 to 5.0% by weight, based on the plastics object which has been mass coloured.

12. A method according to claim 1 wherein the amount of molybdenum disulfide additive is 1.0 to 15.0% by weight, based on the plastics object which is in the form of a coating or printing ink as a dry layer after removal of solvent.

* * * * *